US006686109B2

(12) United States Patent
Matsuoka et al.

(10) Patent No.: US 6,686,109 B2
(45) Date of Patent: Feb. 3, 2004

(54) ELECTROPHOTOGRAPHIC PROCESS AND APPARATUS

(75) Inventors: Hideaki Matsuoka, Shizuoka (JP); Yoshio Segi, Shizuoka (JP); Hiroyuki Katagiri, Shizuoka (JP); Tetsuya Karaki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/106,440

(22) Filed: Mar. 27, 2002

(65) Prior Publication Data

US 2003/0049556 A1 Mar. 13, 2003

(30) Foreign Application Priority Data

Mar. 28, 2001 (JP) ..... 2001-093260
Mar. 22, 2002 (JP) ..... 2002-080894

(51) Int. Cl.[7] ..... G03G 13/22

(52) U.S. Cl. ..... 430/100; 430/66; 430/67; 430/125

(58) Field of Search ..... 430/66, 67, 100, 430/125; 399/159, 350

(56) References Cited

U.S. PATENT DOCUMENTS 5,729,800 A 3/1998 Ohba et al. ..... 399/159
2002/0051920 A1 5/2002 Owaki et al. ..... 430/66

FOREIGN PATENT DOCUMENTS

| | | |
|---|---|---|
| EP | 0777164 | 6/1997 |
| EP | 0825493 | 2/1998 |
| EP | 0913733 | 5/1999 |
| EP | 957413 A2 * | 11/1999 |

* cited by examiner

*Primary Examiner*—Janis L. Dote
(74) *Attorney, Agent, or Firm*—Fitzpatrick, Cella, Harper & Scinto

(57) ABSTRACT

In an electrophotographic process using an amorphous silicon photosensitive member which has a surface protective layer and effecting reverse development and cleaning with a cleaning blade, the surface moving speed PS (mm/sec) of the photosensitive member is 320 mm/sec or more and a film thickness and a specific resistance value of the surface protective layer are respectively Ds (μm) and Rs (Ω·cm) which fulfill the following conditions:

$$1.0\times10^{9}\leqq Rs\leqq1.0\times10^{13}$$

$$Ds\leqq-0.136Ln(Rs)+(-0.004\times PS+6).$$

2 Claims, 8 Drawing Sheets

ELECTROPHOTOGRAPHIC PROCESS AND APPARATUS

BACKGROUND OF THE INVENTION

1. Field of the Invention

The present invention relates to an electrophotographic apparatus in which the surface of a photosensitive member (or an image bearing member) is charged, image information is written on the charged surface by visible light, line scanning laser light or the like to be made into toner images, and the toner images are transferred to a transfer material, thereby carrying out image formation, and the photosensitive member surface after the transfer process is cleaned with a cleaning means. More specifically, the present invention is directed to such as printers, copying machines, facsimile machines, etc. using an amorphous silicon drum (the "amorphous silicon is hereinafter referred to as a-Si).

2. Related Art

Electrophotographic apparatus based on the so-called Charlson's process have been well-known in which each of the process means for conducting exposure, development, transfer, cleaning (residual toner removal), decharging and charging is arranged on the periphery of a photosensitive drum and image formation is carried out through a predetermined electrophotographic process.

In cleaning devices, particularly, a cleaning blade made of a belt-like elastic material such as urethane rubber is often used. Such a cleaning blade is excellent for removing toner remaining on a photosensitive member and widely used in electrophotographic apparatus whose speeds range from high to low.

In recent years, among the photosensitive drums used in electrophotographic apparatus, some use an a-Si photosensitive drum for the purpose of improving durability and making maintenance free. For the a-Si photosensitive drum, it is suggested that amorphous silicon carbide (hereinafter referred to as a-SiC) or amorphous carbon (hereinafter referred to as a-C) may be used as a surface protective layer. Since such a surface protective layer is much harder than the surfaces of organic photosensitive drums, with respect to cleaning with the above-mentioned cleaning blade, it is almost abrasion free and exhibits high durability, so that it is very useful in high speed electrophotography.

In recent digital electrophotographic processes, a photosensitive member is uniformly charged, then latent images are formed on the photosensitive member by laser or LED array, and the latent images on the photosensitive member are developed with a developer by a developing means. The developing method includes a reverse developing method in which portions where latent images are formed by laser, etc. are developed with a developer and a normal developing method in which portions where latent images are not formed are developed with a developer.

In analog electrophotographic processes, reflected light from an original on a stand is used as a latent image forming means, hence a normal development method is used.

With the digital electrophotographic process, both the reverse and normal developing methods may easily be applied, but taking account of the light emission intensity or lifetime of a laser or LED array, it is advantageous to shorten the length of time the light is emitted by the laser or LED array emits light as much as possible, hence the reverse developing method is more useful than the normal developing method.

In addition, Although, even in digital electrophotographic apparatus, its copying speed was heretofore 30 to 40 sheets (A4-sized, widthwise) per minute, with the increased speed of current electrophotographic apparatus, electrophotographic apparatus having a copying speed of 60 sheets (A4-sized, widthwise) or more per minute has appeared. As a result, the moving speed of the photosensitive member surface needs to be about 260 mm/second or more.

For cleaning such a surface moving at a high speed, a cleaning method is suited in which the developer remaining on the electrophotographic apparatus is cleaned with a cleaning blade so provided as to come into contact with the photosensitive member surface. However, it was found that in the reverse developing method, when cleaning the surface moving at a high speed, a new problem occurred.

In the reverse developing method, the charge polarity of the photosensitive member is the same as that of the developer. In the process using the photosensitive member and developer having the same polarity, when cleaning the developer from the photosensitive member surface moving at a high speed, a phenomenon occurs giving, at the time the developer is stripped off the photosensitive member, a charge opposite to the polarity of the developer to the photosensitive member surface (static discharge phenomenon).

The discharge amount is very slight, but the size of the developer is as small as a few microns and the resistance of the developer is high, hence the static discharge concentrates at a minute area on the photosensitive member surface, thus such a discharge amount is sufficient to destroy the charge retaining ability of the surface protective layer of the photosensitive member.

As a result, the photosensitive member deteriorates in its ability to retain the charge with the same polarity as the photosensitive member and results in image defects. Such a discharge phenomenon (hereinafter referred to as sripping discharge) may occur more frequently as the developer stripping speed is higher, i.e., the surface moving speed is faster, and as the developer to be cleaned is greater.

SUMMARY OF THE INVENTION

The object of the present invention is to provide an electrophotographic process and an electrophotographic apparatus which prevent image defects caused by stripping discharge due to high speed operation from occurring and have high durability.

Specifically, the present invention provides an electrophotographic process which comprises the step of:

pre-exposing a photosensitive member comprising a conductive substrate, and a photoconductive layer formed of a non-single crystal material containing silicon and a surface protective layer overlaid on the substrate, charging the photosensitive member, forming a latent image on the photosensitive member, developing the latent image by reverse development, and cleaning the photosensitive member surface with a cleaning blade so provided as to come into contact with the photosensitive member, wherein a surface moving speed of the photosensitive member PS (mm/second) is 320 mm/second or more, and where a film thickness and a specific resistance of the surface protective layer are represented respectively by Ds ($\mu$m) and Rs (ohm.m), the following conditions are satisfied:

$$1.0\times10^{9}\leqq Rs\leqq1.0\times10^{13}$$

$$Ds\leqq-0.136Ln(Rs)+(-0.004\times PS)$$

in which Ln represents a natural logarithm) wherein, when on completion of 1,000,000-sheet copies of a sequence of solid black images having a latent image density of 100%, a dark portion potential of the photosensitive member is measured by a potential measuring method using a voltage direct-application method, the following conditions are satisfied:

$$(Vd0-Vd1)/Vd0\leqq0.30$$

where Vd0 is a potential at an initial stage and Vd1 is a potential on completion of 1,000,000-sheet copies.

In addition, the present invention also provides an electrophotographic apparatus using the above electrophotographic process.

DETAILED DESCRIPTION OF THE PREFERRED EMBODIMENT

As a result of extensive research on the solution of the afore-mentioned problems, it was found that the charge generated by the stripping discharge immediately escapes from the surface protective layer to the sublayer and the strong electric field created by the stripping discharge on the surface protective layer surface is prevented from occurring, thereby preventing the charge retaining ability of the surface protective layer from deteriorating. The present invention was made on the basis of such findings.

That is, it was found that image defects can be prevented from occurring over a long period of time where both the thickness and specific resistance of the surface protective layer are set to be in a certain range and a lowering rate of the dark portion potential of the photosensitive member is regulated to be 30% or less.

There will be described below a preferred layer constitution of the photosensitive member used in the present invention for the amorphous silicon type electrophotography and a process and device for producing the layer constitution as well as the electrophotographic process and electrophotographic apparatus of the present invention.

[Layer Constitution]

Figure 1A:
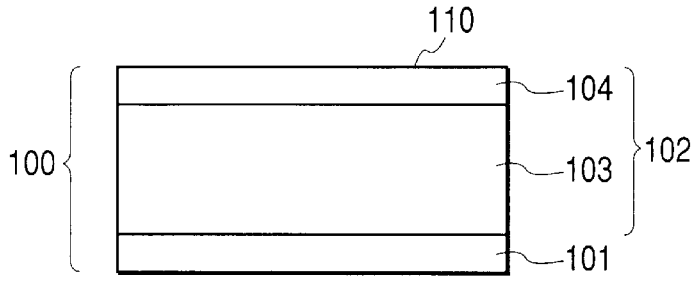
FIGS. 1A, 1B and 1C are cross-sectional views showing the layer constitution of each of the photosensitive members used in the present invention.
Figure 1B:
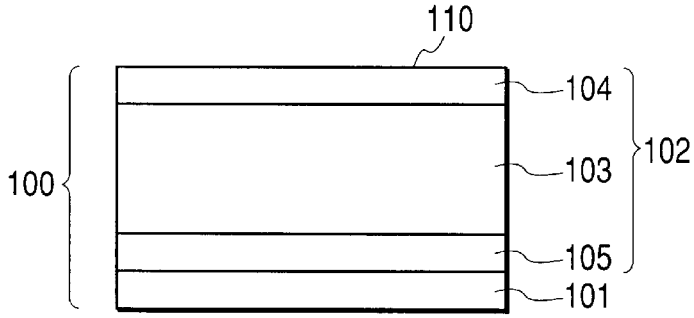
Figure 1C:
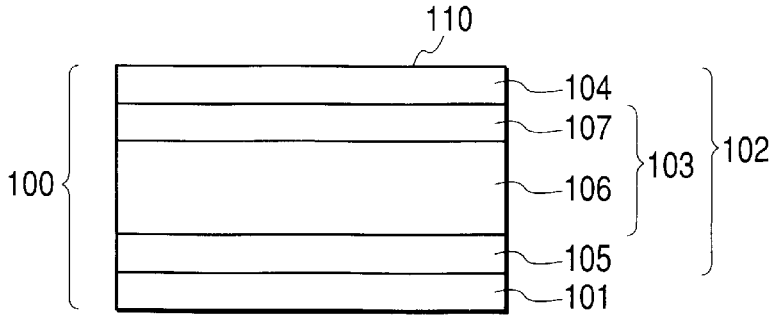

FIGS. 1A to 1C show examples of the layer constitution of the photosensitive member of the electrophotographic process and apparatus of the present invention. As shown in each of FIGS. 1A to 1C, the photosensitive member 100 is provided with a photoreceptive layer 102 formed on a conductive substrate 101 and a surface protective layer 104 formed on the side of the free surface 110 of the photosensitive member.

In the photosensitive member shown in FIG. 1A the photoreceptive layer 102 has a photoconductive layer 103 composed of amorphous silicon containing hydrogen and/or halogen (a-Si (H,X)) and the surface protective layer 104 composed of amorphous silicon carbide containing hydrogen and/or halogen (a-SiC(H,X)) or amorphous carbon containing hydrogen and/or halogen (a-C(H,X)).

In the photosensitive member shown in FIG. 1B the photoreceptive layer 102 has a charge injection inhibiting layer 105, the photoconductive layer 103 composed of a-Si(H,X) and the surface protective layer 104 composed of a-SiC or a-C.

In the photosensitive member shown in FIG. 1C, the photoreceptive layer 102 has the charge injection inhibiting layer 105, the photoconductive layer 103 composed of a-Si(H,X) and the surface protective layer 104 composed of a-SiC(H,X) or a-C(H,X). In FIG. 1C, the photoconductive layer 103 is comprised of a charge generating layer 107 and a charge transporting layer 106.

[Conductive Substrate]

Each of the layers mentioned above will be explained below in detail.

As the conductive substrate of the photosensitive member used in the present invention, the following may be used: for example, a metal such as Al, Cr, Mo, Au, In, Nb, Te, V, Ti, Pt, Pd and Fe, and an alloy thereof such as stainless steel, and an insulation material in which at least the surface on which the photoreceptive layer is formed has been subjected to conducting treatment to be made conductive.

[Photoconductive Layer]

The photoconductive layer 103 used in the present invention, which is formed on the substrate 101 for the purpose of achieving the object of the present invention and constitutes at least part of the photoreceptive layer 102, may be made by, for example, a vacuum deposition film forming method. When making it, the numerical conditions of film formation parameters are appropriately set and feed gases to be used, etc. are selected in order to obtain desired properties. The method for making it specifically includes various thin film deposition methods, for example, a glow discharge method (an A.C. discharge CVD method such as a low-frequency CVD method, a high-frequency CVD method or a microwave CVD method, or a D.C. discharge CVD method), a sputtering method, a vacuum evaporation method, an ion plating method, a light CVD method and a heat CVD method. These thin film deposition methods are appropriately selected and adopted in accordance with factors such as production conditions, a load degree under capital investment in plant and equipment, a production scale, properties desired for an photosensitive member for electrophotography which is to be made, etc. Since it is relatively easy to control conditions for producing an electrophotographic photosensitive member having desired properties, preferred is the use of a high-frequency grow discharge method applying a power source frequency of a RF band (13.56 MHz) or a VHF band (50 to 450 MHz).

For example, the photoconductive layer 103 may be formed by a grow discharge method as follows:

introducing a Si-feeding gas capable of feeding silicon atoms (Si) and a H-feeding gas capable of feeding hydrogen atoms (H) and/or a X-feeding gas capable of feeding halogen atoms (X), which are in a desired gas state, into a reaction vessel the inside of which can be brought into reduced pressure, causing grow discharge in the reaction vessel, and forming a layer composed of a-Si(H,X) on the substrate 101 set at a predetermined position.

In addition, the hydrogen atoms and/or halogen atoms contained in the photoconductive layer is necessary for ensuring unbound valences of silicon atoms and for improving the layer quality, particularly photoconductive properties and charge retaining properties. Where hydrogen atoms or halogen atoms are contained in the photoconductive layer, the content of hydrogen atoms or halogen atoms is preferably 10 to 30 atom %, more preferably 15 to 25, based on the sum of silicon atoms and hydrogen atoms or halogen atoms. Where hydrogen atoms and halogen atoms are contained in the photoconductive layer, the content of the sum of hydrogen atoms and halogen atoms is preferably 10 to 30 atom%, more preferably 15 to 25, based on the sum of silicon atoms, hydrogen atoms and halogen atoms.

The material usable for the Si-feeding gas includes gaseous or gasifiable silicon hydride (silane) such as $SiH_4$, $Si_2H_6$, $Si_3H_8$, $Si_4H_{10}$, etc. Of these, $SiH_4$ and $Si_2H_6$ are preferred considering that when forming the layer, they are easy to handle and good in its Si feeding efficiency.

In order to easily control the incorporation rate of hydrogen atoms into the photoconductive layer structure, it is useful that the layer formation is carried out in an environment in which H2 and/or He or a gas of a silicon compound containing hydrogen are mixed in desired amounts. Not only a gas, but also a mixture of gases may be used.

The gas usable for feeding halogen atoms includes preferably halogen gases, halides, interhalogen compounds, gaseous or gasifiable silane derivatives substituted with halogen. Further, gaseous or gasifiable halogen-containing silicon hydrides may be named as the usable halogen-feeding gas. The preferably usable halides specifically include fluorine gas (F2), and interhalogen compounds such as BrF, ClF, $ClF_3$, $BrF_3$, $BrF_5$, $IF_3$ and $IF_7$. The halogen-containing silicon hydrides (or the so-called silane derivatives substituted with halogen) specifically include silicon fluorides such as $SiF_4$, $Si_2F_6$, etc., which may be preferably used.

The amount of hydrogen atoms and/or halogen atoms contained in the photoconductive layer 103 may be regulated by controlling, for example, the temperature of the substrate 101, the amounts of the materials introduced into the reaction vessel for incorporating hydrogen atoms and/or halogen atoms into the layer, the discharge electric power, and the like.

It is preferred that, if necessary, an element may be incorporated into the photoconductive layer 103 to adjust its conductivity. Such an element may be uniformly incorporated throughout the photoconductive layer, but it is tolerable that there are parts in which its distribution is not uniform in the layer thicness direction.

The above element usable for adjusting the conductivity includes impurities used in the semiconductor field, including the elements belonging to the group 13 (or the group III-A) of the periodic table (hereinafter referred to as "the group 13 element"), which impart p-type conductive properties, and the elements belonging to the group 15 (or the group V-A) of the periodic table (hereinafter referred to as "the group 15 element"), which impart n-type conductive properties. The group 13 element specifically includes boron (B), aluminum (Al), Gallium (Ga), indium (In), thallium (Ti), etc., and in particular, B, Al and Ga are preferred. The group 15 element specifically include phosphorous (P), arsenic (As), antimony (Sb), etc., and in particular, P and As are preferred. The content of the element which is incorporated into the photocunductive layer 103 to impart conductivity, is $1\times10^{-2}$ to $1\times10^{3}$ atom ppm, preferably $5\times10^{-2}$ to $5\times10^{2}$ atom ppm, and more preferably $1\times10^{-1}$ to $1\times10^{2}$ atom ppm.

In order to structurally incorporate the element for adjusting conductivity, for example, the group 13 element or the group 15 element, when forming the layer, a material for incorporating the group 13 element or the group 15 element may be introduced in a gas state into the reaction vessel along with the other gases for forming the photoconductive layer 103. As the material for incorporating the group 13 element or the group 15 element, preferred is the use of materials which are gaseous at normal temperature and normal pressure or can be easily gasified under layer forming conditions.

In the photoconductive layer being positively charged, the material usable for incorporating the group 13 element, particularly boron, specifically includes boron hydrides such as $B_2H_6$, $B_4H_{10}$, $B_5H_{11}$, $B_6H_{10}$, etc. and boron halides such as $BF_3$, $BCl_3$, $BBr_3$, etc. In aadition, $GaCl_3$ and $Ga(CH_3)$ are also named. Among these, $B_2H_6$ is one of preferable materials from the viewpoint of handling.

In the photoconductive layer being negatively charged, the material usable for incorporating the group 15 element, particularly phosphorous, specifically includes phosphorous hydrides such as $PH_3$, $P_2H_4$, etc. and phosphorus halides such as $PF_3$, $PF_5$, $PCl_3$, $PCl_5$, $PBr_3$, $PI_3$, etc. In addition, the following also may be used as the material for incorporating the group 15 element: $AsH_3$, $AsF_3$, $AsCl_3$, $AsBr_3$, $AsF_5$, $SbH_3$, $SbF_5$, $SbCl_5$, $BiH_3$, $BiBr_3$, etc. If necessary, the material for incorporating the element to adjust conductivity may be diluted with $H_2$ and/or He.

The thickness of the photoconductive layer 103 may be suitably determined according to desired or required properties, and is normally 10 to 50 $\mu$m and preferably 20 to 40 $\mu$m.

A flow rate of $H_2$ and/or He used as dilution gas is suitably selected for an optimum range according to layer design, and is preferably controlled in the range of 3 to 20 times the flow rate of the gas for feeding Si. In addition, the flow rate is preferably kept constant in such a range.

An optimum range of gas pressure in the reaction vessel is suitably selected according to layer design, and usually, is $1.0\times10^{-2}$ Pa to $1.0\times10^{3}$ Pa, and preferably, $1.0\times10^{-1}$ Pa to $1.0\times10^{2}$ Pa. Although the optimum range of electric discharge power is suitably selected according to layer design, it is preferable to set a ratio of the discharge electric power to a flow rate of the gas for feeding Si to be the range of 2 to 7. Furthermore, the temperature of the substrate 101 is preferably set to be 200 to 350° C., although its optimum range is suitably selected according to layer design.

The above-described ranges of the temperature of the substrate and the gas pressure for forming the photoconductive layer are mentioned as desirable numerical ranges, but usually, these conditions are not separately determined, and hence, it is preferable to determine optimum values based on mutual and organic relevance so as to form the photoreceptive member having desired properties.

[Surface Protective Layer]

As described above, the surface layer 104 made of a-SiC (H,X) or a-C(H,X) is further formed on the photoconductive layer 103 formed on the substrate 101. This surface layer 104 has a free surface 110 and is provided for achieving the object of the present invention in characteristics on continuous repeated use, resistance to voltage, and operation environment.

The surface layer 104 may be of any material of a-SiC (H,X) or a-C(H,X). In the present invention, in order to effectively achieve the object, the surface protective layer 104 is produced by suitably setting the numerical conditions of film formation parameters by a vacuum deposition film forming method so that desired characteristics may be obtained. Specifically, it is possible to apply such methods as mentioned above in the formation of photocnductive layer, but, it is preferable to use the same deposition method as used in the formation of the photoconductive layer from the viewpoint of the productivity of the electrophotographic photosensitive member.

For example, the surface protective layer 104 may be formed by a glow discharge method as follows: introducing a material gas for Si supply which can supply silicon atoms (Si), a material gas for C supply which can supply carbon atoms (C) and a material gas for H supply that can supply hydrogen atoms (H) and/or a material gas for X supply which can supply halogen atoms (X), which are in a desired gas state, into a reaction vessel the inside of which can be made into reduced pressure; making glow discharge occur in the reaction vessel; and forming a layer composed of a-SiC (H,X) on a substrate 101 set at a predetermined position, on which a photoconductive layer 103 has been formed.

As material which may serve as gases for Si supply used in the formation of the surface protective layer, silicon hydrides (silanes) such as $SiH_4$, $Si_2H_6$, $Si_3H_8$, and $Si_4H_{10}$ which are in a gas state, or can be gasified can be mentioned as what is used effectively, and, from the viewpoint of the ease of handling at the time of layer production and high Si supply effectiveness etc., $SiH_4$ and $Si_2H_6$ are preferable. In addition, the material gas for supplying Si may be diluted with a gas such as $H_2$, He, Ar, and Ne, if necessary.

As material which may serve as gases for C or a-C supply, hydrocarbon such as $CH_4$, $C_2H_2$, $C_2H_6$, $C_3H_8$, and $C_4H_{10}$, which are in a gas state or can be gasified, can be mentioned as what is used effectively, and, from the viewpoint of the ease of handling at the time of layer production and high C supply effectiveness, etc., $CH_4$, $C_2H_2$, and $C_2H_6$ are preferable. In addition, the material gas for supplying C may be diluted with a gas such as $H_2$, He, Ar, and Ne, if necessary.

The thickness range of the surface protective layer 104 is 0.05 to 3 $\mu$m, and more preferably, 0.1 to 1 $\mu$m. If the thickness is thinner than 0.05 $\mu$m, the surface layer may be lost because of abrasion. in the use of the photoreceptive member, and if it exceeds 3 $\mu$m, the deterioration in electrophotographic characteristics such as increase of residual potential may arise.

The surface protective layer 104 is carefully formed so that the demanded characteristics may be given as desired. A surface protective layer 104 may structurally have forms of from a polycrystalline form or a microcrystalline form to an amorphous form (generically called non-single crystal) according to the formation conditions and exhibits the properties of from conductivity to semiconductivity and insulation in electric physical properties, and exhibits the properties of from photoconductivity to non-photoconductivity in photoconductive properties. Hence, in the present invention, the selection of the formation conditions is strictly made according to a demand so that a compound having desired characteristics meeting the demand may be formed.

The film thickness of the surface protective layer may be controlled with the length of time the surface protective layer is formed. For example, where amorphous silicon carbide containing hydrogen a-SiC(H) is used as the surface protective layer, it is possible to control the specific resistance value of the surface protective layer by controlling a ratio of the material gas $SiH_4$ for Si supply and a material gas $CH_4$ for C supply which can supply a carbon atom (C).

Where amorphous carbon containing hydrogen (a-C(H)) is used as the surface protective layer, the specific resistance value of the surface protective layer may be controlled by employing as parameters the pressure and discharge electric power in a reaction vessel when the material gas $CH_4$ for C supply which can supply carbon atoms (C) is introduced into the reaction vessel.

[Charge Injection Inhibiting Layer]

In the electrophotographic photosensitive member, it is much more effective to provide the charge injection inhibiting layer, which prevents the injection of charges from a conductive substrate, between the conductive substrate and the photoconductive layer. Namely, the charge injection inhibiting layer (105) has a function of preventing charges from being injected from the substrate to the photoconductive layer when the photoreceptive layer 103 receives a certain polarity of electrification on its free surface, and such a function is not exhibited when receiving the reverse polarity of electrification. In order to give such a function, the charge injection inhibiting layer is made to contain more atoms controlling conductivity, in comparison with the photoconductive layer.

As the elements which are contained in the charge injection inhibiting layer and control conductivity, so-called impurities in the semiconductor field can be mentioned, and it is possible to use elements belonging to the group 13 that give p-type conductive characteristics, or elements belonging to the group 15 that give n-type conductive characteristics.

As the group 13 elements contained in the charge injection inhibiting layer for positive electrification, specifically, there are B (boron), Al (aluminum), Ga (gallium), In (indium), Ta (thallium), etc., and in particular B, Al, and Ga are suitable. In addition, as the group 15 elements contained in the charge injection inhibiting layer for negative electrification, specifically, there are P (phosphorus), As (arsenic), Sb (antimony), Bi (bismuth), etc., and in particular P and As are suitable. The layer thickness of the charge injection inhibiting layer 105 is preferably 0.1 to 3 $\mu$m, and more preferably 0.5 to 3 $\mu$m.

In order to form the charge injection inhibiting layer, the same vacuum deposition method as the method of forming the above-mentioned photoconductive layer is employed.

In order to form the charge injection inhibiting layer 105 with the characteristics for achieving the object of the present invention, it is required, as in the photoconductive layer 103, to suitably set a mixing ratio of the gas for Si supply and the dilution gas, the gas pressure in the reaction vessel, the discharge electric power, and the temperature of the substrate 101.

In the present invention, as the desirable numerical ranges of a mixing ratio of the dilution gas, gas pressure, electric discharge power, and the temperature of the substrate for forming the charge injection inhibiting layer, the same ranges as those for the photoconductive layer are mentioned, but usually, these conditions are not separately determined, and hence, it is preferable to determine optimum values based on mutual and organic relevance so as to form the surface layer which has desired characteristics.

Next, in regard to typical examples of an apparatus and a method for forming each layer described above, an RF-PCVD method and a VHF-PCVD method will be described below.

[RF-PCVD Method]

Figure 2:
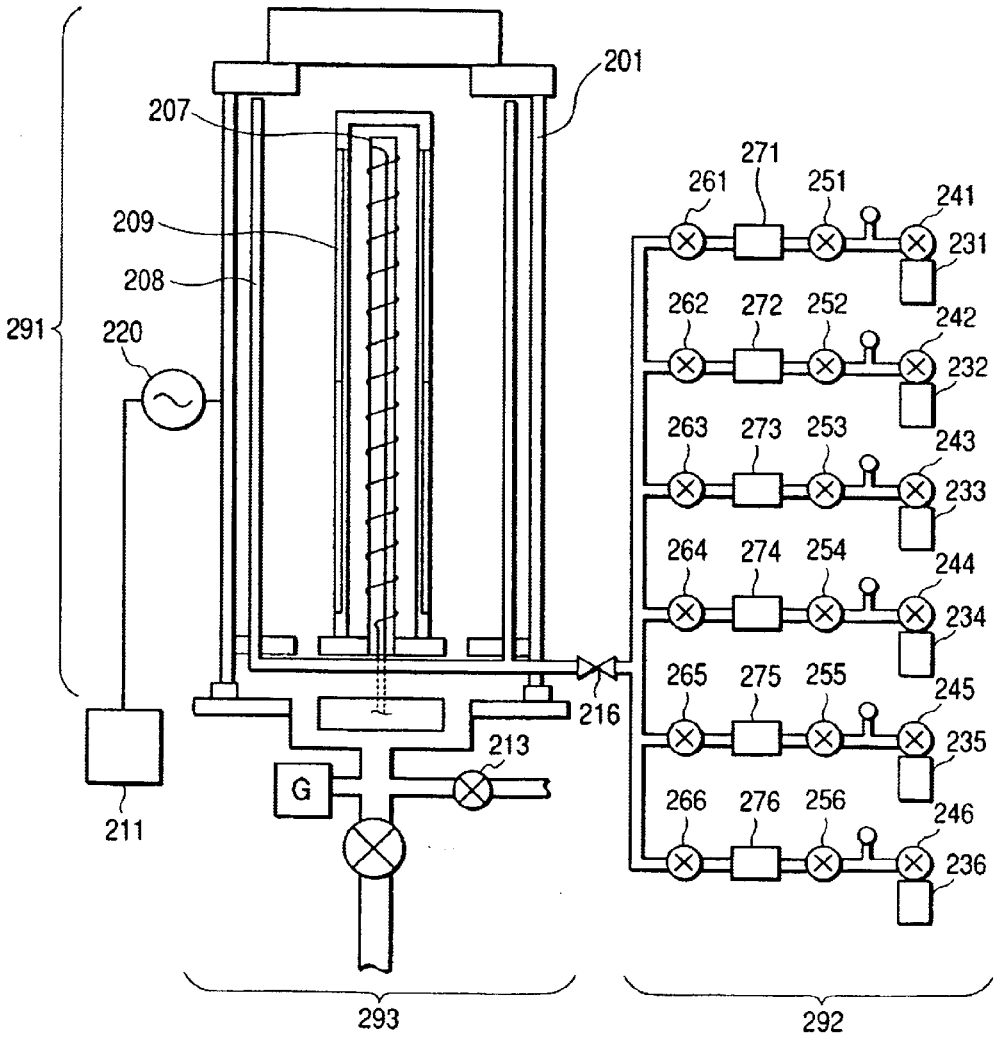
FIG. 2 is a schematic illustration of a RF plasma CVD device for forming the photosensitive member used in the present invention.

The apparatus and the film formation method for forming the photoreceptive layer will be described in detail. FIG. 2 is a schematic structural diagram showing a preferable example of the production apparatus of an electrophotographic photoreceptive member by an RF plasma CVD method (hereinafter an "RF-PCVD") using a frequency in an RF band. The configuration of the production apparatus shown in FIG. 2 is as follows.

This apparatus is roughly divided into a deposition apparatus 291, a material gas feeder 292, a reaction vessel 201, and an exhauster 293 for bring the inside of the reaction vessel into a reduced pressure. In the reaction vessel 201, a cylindrical substrate 209, a heater 207 for heating the substrate, and a material gas supply tube 208 are installed, and a high-frequency matching box 220 and a high-frequency power source 211 are connected further.

The material gas feeder 292 comprises gas cylinders 231 to 236 for material gases such as $SiH_4$, $GeH_4$, $H_2$, $CH_4$, $B_2H_6$, and $PH_3$, valves 261 to 266, and mass flow controllers 271 to 276, and the gas cylinder for each material gas is connected to the gas supply tube 208 in the reaction vessel 201 through the valve 216.

Each layer of a deposited film can be formed by using this apparatus, for example, as follows.

First, the cylindrical substrate 209 is installed in the reaction vessel 201, and the inside of the reaction vessel 201 is evacuated with the exhauster 293. Then, the temperature of the cylindrical substrate 209 is regulated by the heater 207 for heating the substrate to be a predetermined temperature of, for example, 200° C. to 400° C.

When the cylindrical substrate 209 becomes the predetermined temperature, valves necessary for film formation by plasma processing are opened among material gas cylinder valves 241 to 246, inflow valves 251 to 256 and outflow valves 261 to 266, and the material gases from the material gas cylinders 231 to 236 are adjusted to a predetermined flow rate by the mass flow controllers 271 to 276, and are introduced into the reaction vessel 201 through the material gas supply tube.

At that time, the pressure in the reaction vessel 201 is so adjusted as to be the predetermined pressure of about $1.5\times10^2$ Pa or less. When the internal pressure is stabilized, an RF power source with a frequency of 13.56 MHz is set to desired power, the RF power is applied to the reaction vessel 201 through the high-frequency matching box 220, and glow discharge is allowed to occur. The material gas introduced in the reaction vessel is decomposed by this discharge energy, and the predetermined deposition film whose principal component is silicon is formed on the cylindrical substrate 209. After the film with the desired film thickness is formed, the supply of the RF power is stopped, the outflow valve is closed to stop the inflow of the gas into the reaction vessel, and the formation of the deposition film is finished.

By repeating the same operation two or more times, the photoreceptive layer with desired multi-layer structure is formed.

In addition, in order to attain uniformity of film formation, it is also effective to rotate the substrate 209 at a predetermined speed by a driving unit (not shown) while performing the film formation.

Furthermore, the aforementioned gases and valve operation will be changed according to production conditions of each layer.

[VHF-PCVD Method]

Next, a production method of the electrophotographic photoreceptive member formed by a high-frequency plasma CVD method (hereinafter "VHF-PCVD") using the frequency in a VHF band will be described below.

Figure 3:
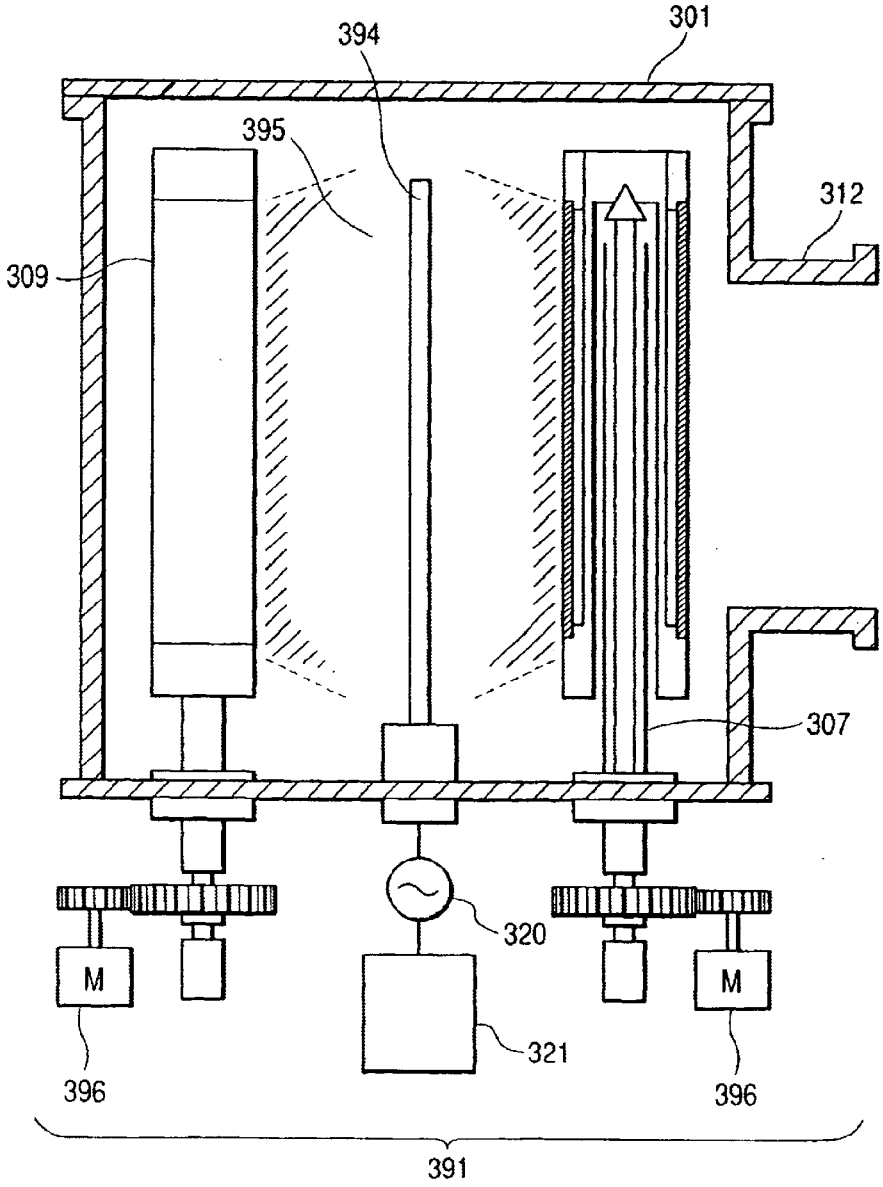
FIG. 3 is a schematic illustration of a VHF plasma CVD device for forming the photosensitive member used in the present invention.

An electrophotographic photosensitive member production apparatus by the VHF-PCVD method can be obtained by replacing the deposition apparatus 291 by the RF-PCVD method in the production apparatus shown in FIG. 2 with a deposition apparatus 391 shown in FIG. 3, and connecting the deposition apparatus 391 with the material gas feeder 292.

This apparatus is roughly divided into a reaction vessel 301, a material gas feeder (not shown), an exhauster (not shown) for reducing the pressure inside the reaction vessel. In the reaction vessel 301, a cylindrical substrate 309, a heater 307 for heating the substrate, a material gas supply tube (not shown), and an electrode 394 are installed, and a high-frequency matching box 320 and a high-frequency power source 321 are connected further.

A deposition film may be formed using this apparatus by the VHF-PCVD method as follows.

First, a cylindrical substrate 309 is installed in the substrate holder 309 in the reaction vessel 301, the substrate 309 is rotated by a driving unit 396, the inside of the reaction vessel 301 is evacuated through an exhaust pipe 312 by an exhauster such as a diffusion pump (not shown), and the pressure in the reaction vessel 301 is adjusted to $1.0\times10^3$ Pa or less. Then, the temperature of the cylindrical substrate 309 is regulated by the heater 307 for heating the substrate to be a predetermined temperature of, for example, 200° C. to 400° C.

The material gas for forming a deposition film is introduced into the reaction vessel 301 from a material gas feeder (not shown) by the same method as in the apparatus shown in FIG. 2.

As described above, after the preparation of film formation is completed, each layer is formed on the cylindrical substrate 309 as follows.

When the cylindrical substrate 309 reaches predetermined temperature, required values among the outflow valves (not shown) and auxiliary valves (not shown) are gradually opened to introduce a predetermined gas into an electric discharge space 395 in the reaction vessel 301 through the gas supply tube (not shown) from a gas cylinder (not shown) Next, each material gas is adjusted by the mass flow-controller (not shown) so as to become a predetermined flow rate. At that time, an aperture of a main valve (not shown) is adjusted with monitoring a vacuum gauge (not shown) so that the pressure in the electric discharge space 395 becomes the predetermined pressure of about $1.5\times10^2$ Pa or less.

When the pressure is stabilized, a VHF power supply 321 with a frequency of 500 MHz is set to desired power, VHF power is introduced into the electric discharge space 395 through a matching box 320, and glow discharge is made to occur. Then, in the electric discharge space 395 enclosed by the substrate 309, the introduced material gas is excited and dissociated by discharge energy, and a predetermined deposition film is formed on the substrate 309. At this time, in order to attain the uniformity of the film formation, the substrate 309 is rotated at a desired rotational speed by a motor 396 for rotating the substrate.

After the film with desired film thickness is formed, the supply of the VHF power is stopped, the outflow valve is closed to stop the inflow of the gas into the reaction vessel, and the formation of the deposited film is finished. By repeating the same operation two or more times, the photoreceptive layer with the desired multi-layer structure is formed.

Next, an electrophotographic process of the present invention will be described below.

[Electrophotographic Process]

Figure 4:
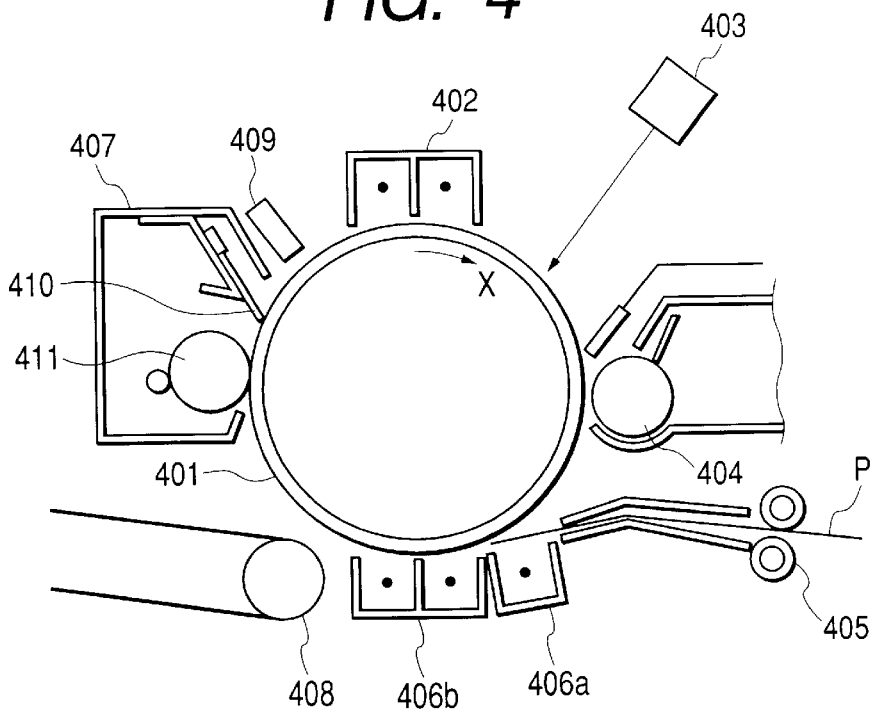
FIG. 4 is a schematic illustration showing an example of the electrophotographic process according to the present invention.

FIG. 4 is a schematic diagram showing an example of the electrophotographic process according to the present invention.

Around the electrophotographic photosensitive member 401 which rotates in the direction shown by an arrow X, a main electrifier 402, an electrostatic latent image formation means 403, a developing apparatus 404, a transfer paper supply system 405, a transfer electrifier 406*a*, a separation electrifier 406*b*, a cleaning apparatus 407, a transport system 408, and a pre-exposure light source 409, etc. are arranged. The temperature of the photosensitive member 401 may be also controlled by an inner face panel heater (not shown), if necessary.

The surface of the photosensitive member 401 is uniformly charged by the main electrifier 402, and an electrostatic latent image is formed by image exposing means 403. This electrostatic latent image is developed by a development sleeve of the developing apparatus 404, to which a developer (toner) has been applied, as a toner image.

The toner image is transferred to a transfer material supplied through the transfer paper supply system 405. This transfer material P is separated from the photosensitive member 401 by separation means such as the separation electrifier 406*b* and/or a pawl and, after the toner image on its surface is fixed with a fixing roller (not shown) of a fixing apparatus (not shown) via the transport system 408, is discharged out of the electrophotographic apparatus.

On the other hand, deposits such as residual toner and paper powder on the surface of the photosensitive member are removed by a cleaning blade 410, a cleaning roller (or brush) 411, etc. in the cleaning apparatus 407, the photosensitive member is served for the next image formation. Then, the photosensitive member 401 is uniformly exposed to light from the pre-exposure light source 409 and decharged, and the next image formation is performed.

(Experiments)

Experiments were conducted in order to search for the conditions of the surface protective layer for preventing deterioration in the charge retention capacity of the surface protective layer due to the stripping discharge as described above will be described below.

(Experiment 1)

Three electrophotographic photosensitive members which have the laminated structure shown in FIG. 1C were produced by the above-described RF-PCVD method in the conditions of Table 1. In addition, the surface protective layer was made of a-SiC(H). As a conductive substrate, a cylindrical aluminum having a diameter of 108 mm and a length of 358 mm was used.

After the film formation was completed, the photosensitive member was taken out of the RF-PCVD apparatus, and the film thickness analysis on whether the desired film thickness of the surface protective layer was achieved was performed by a spectroscopy using "Spectro Multichannel Photodetector MCPD-2000" by Otsuka Electronics Co., Ltd., thus the film thickness of the surface protective layer was measured.

Moreover, in the production conditions for the surface protective layer shown in Table 1, the 1.0 $\mu$m surface protective layer samples were produced by setting 7059 glass substrates made by Corning Inc. as substrates on the same cylindrical aluminum substrate, as used in the production of the electrophotographic photosensitive member. Electrodes were deposited on the produced samples after the film formation, and specific resistance values of the surface protective layers were measured by using "$\mu$A Meter/DC Voltage Scope 4140B" made by HP Inc.

The film thickness (Ds) of the surface protective layer of the produced photosensitive member and the specific resistance value (Rs) of the surface protective layer measured with the samples were Ds=0.55 ($\mu$m) and Rs=1.4E+13=$1.4\times 10^{13}$ ($\Omega\cdot$cm), respectively.

Figure 5:
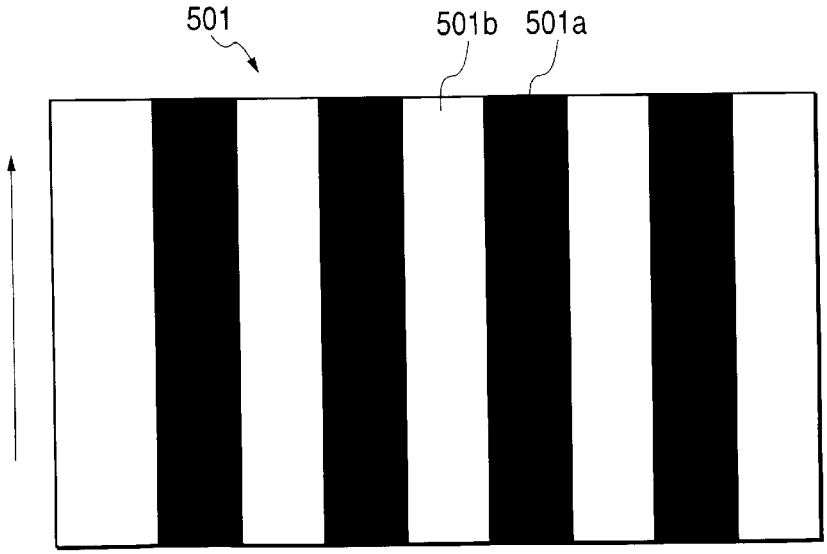
FIG. 5 is a schematic illustration of a chart (image pattern) used in extensive tests in the present invention, in which an arrow indicates a copying progressing direction.

The produced photosensitive members were each mounted on a digital copying machine GP605 (made by Canon Inc.) having the processes shown in FIG. 4, and extensive tests, where in each test, 1,000,000-sheet copies were made on A4-sized paper in the width direction, was performed in three environments shown in Table 2 by using a chart 501 in which, as shown in FIG. 5, a solid black section 501*a* (100% of latent image density) and a solid white section 501*b* (0% of latent image density) were arranged alternately in the rotative direction of the photosensitive member. In addition, this copying machine is in a reverse development system, and is modified so that the surface velocity (PS) of the photosensitive member may become 450 mm/sec.

In regard to the evaluation of the extensive tests, the charge retention ability of the surface protective layer was evaluated by the voltage direct-application method using the dark area potential measurement before and after the extensive test, and whether image defects (blank spot, uneven density, etc.) were present in parts corresponding to the solid black sections in the chart 501 in a halftone image with 50% latent image density was visually evaluated after the extensive test.

(Evaluation of charge retention ability)

Figure 6:
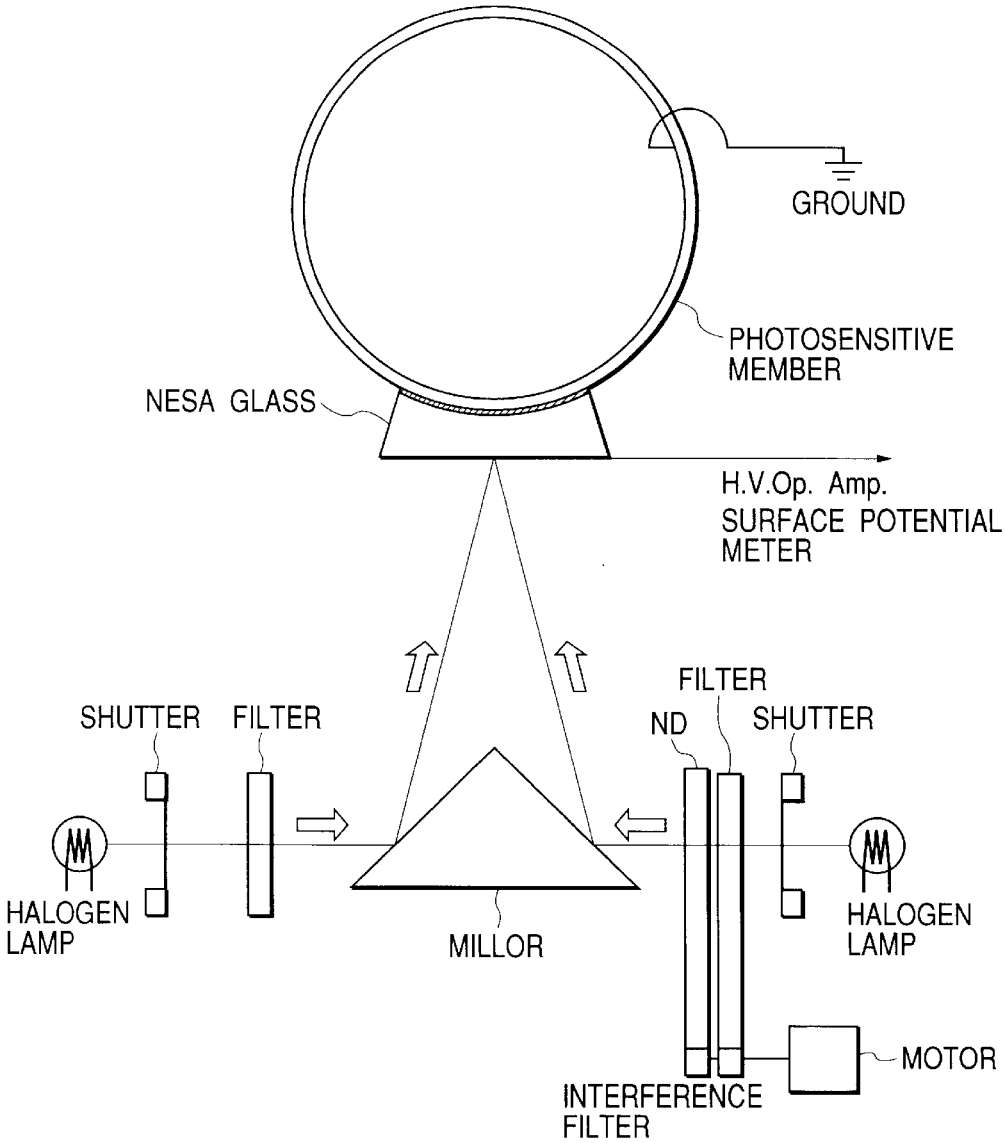
FIG. 6 is a schematic view of a device using a voltage direct-application method used for measuring the potential of the photosensitive member.

The voltage direct-application type photosensitive member measuring device used in this experiment will be described below in detail. As shown in FIG. 6, as for the outline of the device, a high voltage power supply for charging the surface of the photosensitive member amplifies an output from an DC/AC converter by using an operational amplifier with quick response. Since a resistor and a capacitor can be inserted between the high voltage power supply and photosensitive member, if necessary, whereby electrification time can be changed. The DC/AC converter is controlled by a computer. Four light sources are arranged on the front and rear sides and the right and left sides, and exposure is effected by a reflective mirror arranged under the electrode. Various filters can be set between each light source and the photosensitive member.

Figure 7:
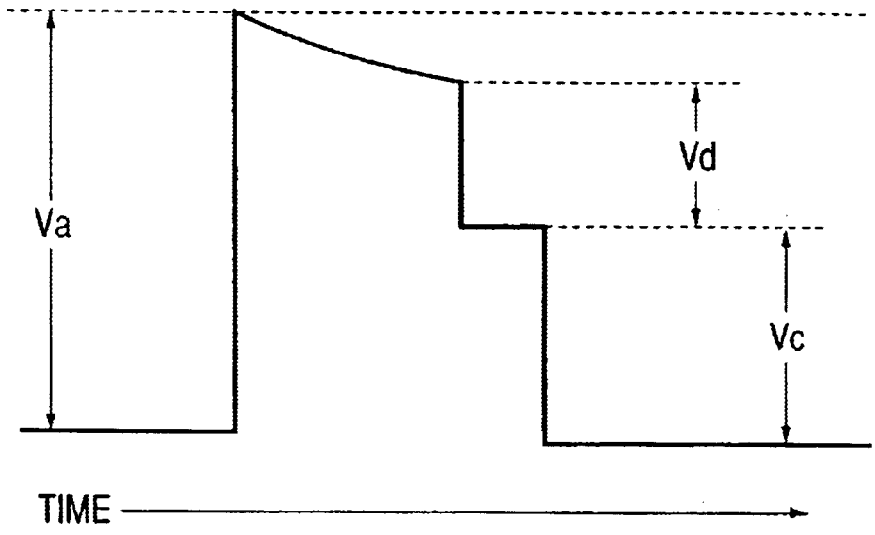
FIG. 7 is a chart showing a measurement sequence of the measurement made using the device shown in FIG. 6.
Figure 8:
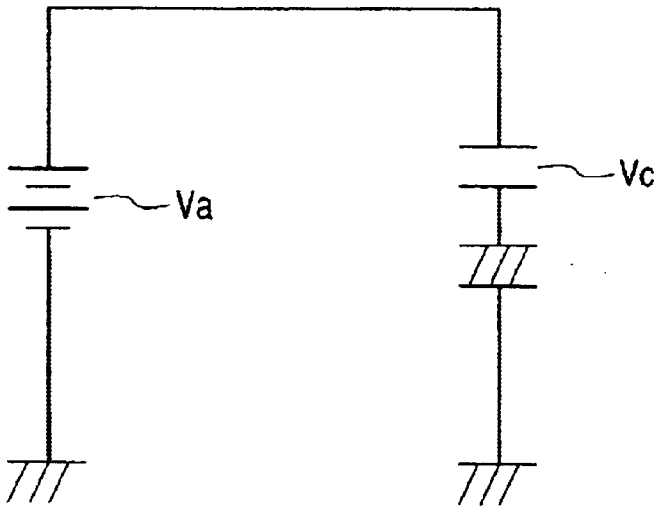
FIG. 8 is a schematic illustration showing the measurement conception of the voltage direct-application method.

Next, the measurement sequence will be described below. This measurement was made regarding the photosensitive member as a capacitor. The measurement sequence is shown in FIG. 7 and the schematic diagram of a measuring circuit is shown in FIG. 8. The measurement was advanced as shown in FIG. 7. Decharging exposure for removing the hysteresis of the photosensitive member and pre-exposure were effected by irradiating the photosensitive member with light from the light sources, and a predetermined application voltage (Va) was applied to the photosensitive member after about 10 msec. Thereafter, the potential corresponding to (Vd+Vc) was measured after about 0.2 sec, then the photosensitive member is grounded after the measurement. Next, the potential measurement of the capacitor potential Vc placed between the high voltage power source and the photosensitive member was performed, and Vd obtained from these results was regarded to be the potential of the photosensitive member. Then, the value obtained by dividing the difference ΔV2(=V0−V1) between the potential V0 of the solid black section before the extensive test and the potential V1 of the solid black section after the extensive test by the potential V0 of the solid black section before the extensive test was regarded to be a potential lowering rate, which was made to be an evaluation parameter of the charge retention ability.

TABLE 1

| Kind of Gas/Conditions | Charge Injection Inhibiting Layer (105) | Photoconductive Layer (103) Carrier Transport layer (106) | Photoconductive Layer (103) Carrier Generating Layer (107) | Surface Protective Layer (104) |
|---|---|---|---|---|
| $SiH_4$ ml/min. (normal) | 200 | 100 | 100 | 10 |
| $H_2$ ml/min. (normal) | 300 | 800 | 800 | |
| Quantity of Group 13 Element to Si Element (ppm) | 2000 | 2 | 0.2 | |
| NO ml/min. (normal) | 5 | | | |
| $CH_4$ ml/min. (normal) | | | | 500 |
| Temperature of Substrate (° C.) | 290 | 290 | 290 | 280 |
| RF Power (W) | 500 | 100 | 100 | 200 |
| Pressure (Pa) | 67 | 67 | 67 | 67 |
| Film Thickness (μm) | 3 | 20 | 10 | 0.5 |

TABLE 2

| | Temperature (° C.) | Humidity (%) |
|---|---|---|
| Environment A (N/L) | 23 ± 2° C. | 5–10% |
| Environment B (N/N) | 23 ± 2° C. | 30–60% |
| Environment C (H/H) | 30 ± 2° C. | 70–85% |

The experimental result is shown in Table 3. In Table 3, the potential decreasing rate after the extensive test in each environment and the evaluation result on the presence of an image defect in a halftone image (50% of latent image density) after the extensive test are shown.

As shown in Table 3, the potential decreasing rate of the environment A in a dark space was worst in this experiment, and was 68.2%. In addition, also in other environments, 30% or more of potential depression was shown, and image defects occurred in each environment.

TABLE 3

| | Potential Decreasing Rate (%) | Image Defect |
|---|---|---|
| Environment A (N/L) | 68.2% | X |
| Environment B (N/N) | 58.3% | X |
| Environment C (H/H) | 46.3% | X |

○: No Image Defect
X: Image Defect Present (Density Unevenness, Image Blank Spot)

(Experiment 2)

Eight photosensitive members were produced under the same conditions as in Experiment 1, and each mounted on the digital copying machine GP605 (made by Canon Inc.) modified so that the surface moving speed of the photosensitive members could be changed from 200 to 600 mm/sec, and the same extensive test as in Experiment 1 was performed in the environment A shown in Table 2. Evaluation was made in the same way as in Experiment 1. The results obtained are shown in Table 4.

As shown in Table 4, the potential depression arises at the surface moving speed of the photosensitive member of 300 mm/sec or more, and exceeds 30% at 320 mm/sec or more. It is confirmed that where the potential drop exceeds 30%, it becomes apparent as an image defect in an image. That is, in a high surface moving speed, it is necessary for the potential decreasing rate to be 30% or less.

TABLE 4

| a-SiC (H) | Surface Moving Speed (mm/sec) | Potential Decreasing Rate | Image Defect |
|---|---|---|---|
| Experiment 2-1 | 200 | 0.0% | ○ |
| Experiment 2-2 | 260 | 0.0% | ○ |
| Experiment 2-3 | 300 | 28.6% | ○ |
| Experiment 2-4 | 320 | 31.8% | X |
| Experiment 2-5 | 380 | 46.9% | X |
| Experiment 2-6 | 450 | 68.2% | X |
| Experiment 2-7 | 500 | 71.2% | X |
| Experiment 2-8 | 600 | 80.1% | X |

○: No Image Defect
X: Image Defect Present (Density Unevenness, Image Blank Spot)

[Experiment 3]

Eight electrophotographic photosensitive members having the laminated structure shown in a FIG. 1C were produced by the above-described RF-PCVD method in the conditions shown in Table 5. In addition, the surface protective layer was made of a-C(H). As a conductive substrate, a cylindrical aluminum having a diameter of 108 mm and a length of 358 mm was used.

After the film formation, the photosensitive member was taken out of the RF-PCVD apparatus and film thickness analysis on whether the desired film thickness of the surface protective layer was achieved was performed by spectroscopy using "Spectro Multichannel Photodetector MCPD-2000" by Otsuka Electronics Co., Ltd., thus the film thickness of the surface protective layer was measured.

Moreover, in the production conditions for the surface protective layer shown in Table 5, the 1.0 μm surface protective layer samples were produced by setting 7059 glass substrates made by Corning Inc. as substrates on the same cylindrical aluminum substrate as used in the production of the electrophotographic photosensitive member. Electrodes were deposited on the produced samples after the film formation, and specific resistance values of the surface protective layers were measured by using "μA Meter/DC Voltage Scope 4140B" by HP Company.

The film thickness (Ds) of the surface protective layer of the produced photosensitive member and the specific resistance value (Rs) of the surface protective layer measured with the samples were Ds=0.55 (μm) and Rs=2.1E+13=($2.1\times10^{13}$) (Ω·cm), respectively.

TABLE 5

| Kind of Gas/Conditions | Charge: Injection Inhibiting Layer (105) | Photoconductive Layer (103): Carrier Transport layer (106) | Photoconductive Layer (103): Carrier Generating Layer (107) | Surface Protective Layer (104) |
|---|---|---|---|---|
| $SiH_4$ ml/min. (normal) | 200 | 100 | 100 | |
| $H_2$ (sccm) | 300 | 800 | 800 | 300 |
| Quantity of Group 13 Element to Si Element (ppm) | 2000 | 2 | 0.2 | |
| NO ml/min. (normal) | 5 | | | |
| $CH_4$ ml/min. (normal) | | | | 500 |
| Temperature of Substrate (° C.) | 290 | 290 | 290 | 280 |
| RF Power (W) | 500 | 100 | 100 | 500 |
| Pressure (Pa) | 67 | 67 | 67 | 67 |
| Film Thickness (μm) | 3 | 20 | 10 | 0.5 |

The same extensive test as in Experiment 2 was performed for these photosensitive members, and the same evaluation as in Experiment 2 was made before and after the extensive test. Its result was summarized in Table 6.

TABLE 6

| a-C (H) | Surface Moving Speed (mm/sec) | Potential Decreasing Rate | Image Defect |
|---|---|---|---|
| Experiment 3-1 | 200 | 0.0% | ○ |
| Experiment 3-2 | 260 | 0.0% | ○ |
| Experiment 3-3 | 300 | 24.6% | ○ |
| Experiment 3-4 | 320 | 33.8% | X |
| Experiment 3-5 | 380 | 50.9% | X |
| Experiment 3-6 | 450 | 72.6% | X |
| Experiment 3-7 | 500 | 75.4% | X |
| Experiment 3-8 | 600 | 84.6% | X |

○: No Image Defect
X: Image Defect Present (Density Unevenness, Image Blank Spot)

As shown in Table 6, the potential depression arises at the surface moving speed of the photosensitive member of 300 mm/sec or more, and exceeds 30% at 320 mm/sec or more. In addition, it can be confirmed that where the potential depression exceeds 30%, it appears as an image defect in an image. From the results of Experiments 2 and 3, regardless of the constitutional elements of the surface protective layer, it can be seen that the deterioration in the charge retention ability of the surface protective layer due to the stripping discharge arises.

[Experiment 4]

Electrophotographic photosensitive members having the laminated structure shown in FIG. 1C were produced by the above-described RF-PCVD method in the conditions shown in Table 7. Photosensitive members having different surface protective layers which have the thickness (Ds) in the range of 0.1 to 1.2 (μm) and the specific resistance (Rs) in the range of of 1.1E+8(=$1.1\times10^{8}$) to 1.4E+13(=$1.4\times10^{13}$) (Ω·cm) were produced by making the surface protective layer of a-SiC(H) and changing the surface protective layer film formation conditions ($SiH_4$ flow rate, $CH_4$ flow rate, RF electric power and film formation time). In addition, as a conductive substrate, a cylindrical aluminum having the diameter of 108 mm and the length of 358 mm was used.

After the film formation, the photosensitive member was taken out of the RF-PCVD apparatus, and the film thickness analysis on whether the desired film thickness of the surface protective layer was achieved was performed by spectroscopy using "Spectro Multichannel Photodetector MCPD-2000" made by Otsuka Electronics Co., Ltd., thus the film thickness of the surface protective layer was measured.

Under the production conditions for the surface protective layer shown in Table 7, the 1.0 μm surface protective layer samples were produced by setting 7059 glass substrates made by Corning Inc. as substrates on the same cylindrical aluminum substrate as used in the production of the electrophotographic photosensitive member. Electrodes were deposited on the produced samples after the film formation, and the specific resistance of the surface protective layers were measured by using "μA Meter/DC Voltage Scope 4140B" made by HP Inc.

The film thickness (Ds) of the surface protective layers of the produced photosensitive member and the specific resistance (Rs) of the surface protective layers measured with the samples are shown in Table 8.

The specific resistance (Ω·cm) is $1.1\times10^{8}$ in Table 8 in the case of a photosensitive member A, and it is expressed as 1.1E+08. The following is the same as above.

TABLE 7

| Kind of Gas/Conditions | Charge: Injection Inhibiting Layer (105) | Photoconductive Layer (103): Carrier Transportation layer (106) | Photoconductive Layer (103): Carrier Generating Layer (107) | Surface Protective Layer (104) |
|---|---|---|---|---|
| $SiH_4$ ml/min. (normal) | 200 | 100 | 100 | 5–20 |
| $H_2$ ml/min. (normal) | 300 | 800 | 800 | |
| Quantity of Group 13 Element to Si Element (ppm) | 2000 | 2 | 0.2 | |
| NO ml/min. (normal) | 5 | | | |
| $CH_4$ ml/min. (normal) | | | | 200–600 |
| Temperature of Substrate (° C.) | 290 | 290 | 290 | 280 |
| RF Power (W) | 500 | 100 | 100 | 100–300 |
| Pressure (Pa) | 67 | 67 | 67 | 67 |
| Film Thickness (μm) | 3 | 20 | 10 | 0.5 |

TABLE 8

| | Film Thickness of Surface Protective Layer (μm) | Specific Resistance Value (Ω · cm) |
|---|---|---|
| Photosensitive Member A | 0.1–1.2 | 1.1E+08 |
| Photosensitive Member B | 0.1–1.2 | 1.1E+09 |
| Photosensitive Member C | 0.1–1.2 | 8.5E+10 |
| Photosensitive Member D | 0.1–1.2 | 2.9E+11 |
| Photosensitive Member E | 0.1–1.2 | 9.5E+12 |

TABLE 8-continued

| | Film Thickness of Surface Protective Layer (μm) | Specific Resistance Value (Ω · cm) |
|---|---|---|
| Photosensitive Member F | 0.1–1.2 | 1.4E+13 |

Photosensitive members A to F were each mounted on the digital copying machine GP605 (made by Canon Inc.) remodeled so that the surface moving speed of the photosensitive members was 450 mm/sec, and the extensive test was made in the same way as in Experiment 1. The extensive test was carried out in the environment A shown in FIG. 2. Evaluation was performed in terms of the potential decreasing rate shown in Experiment 1. The results obtained were shown in Table 9. In Table 9, ○ is marked when the potential decreasing rate is 30% or less, and x is marked when exceeding 30%.

TABLE 9

| Film Thickness (μm) | Photo-sensitive Member A 1.1E+8 | Photo-sensitive Member B 1.0E+9 | Photo-sensitive Member C 8.5E+10 | Photo-sensitive Member D 2.9E+11 | Photo-sensitive Member E 9.5E+12 | Photo-sensitive Member F 1.4E+13 |
|---|---|---|---|---|---|---|
| 0.1 | ○ | ○ | ○ | ○ | ○ | X |
| 0.3 | ○ | ○ | ○ | ○ | X | X |
| 0.4 | ○ | ○ | ○ | ○ | X | X |
| 0.5 | ○ | ○ | ○ | ○ | X | X |
| 0.6 | ○ | ○ | ○ | X | X | X |
| 0.7 | ○ | ○ | ○ | X | X | X |
| 0.8 | ○ | ○ | X | X | X | X |
| 1.0 | ○ | ○ | X | X | X | X |
| 1.2 | ○ | ○ | X | X | X | X |

Figure 9:
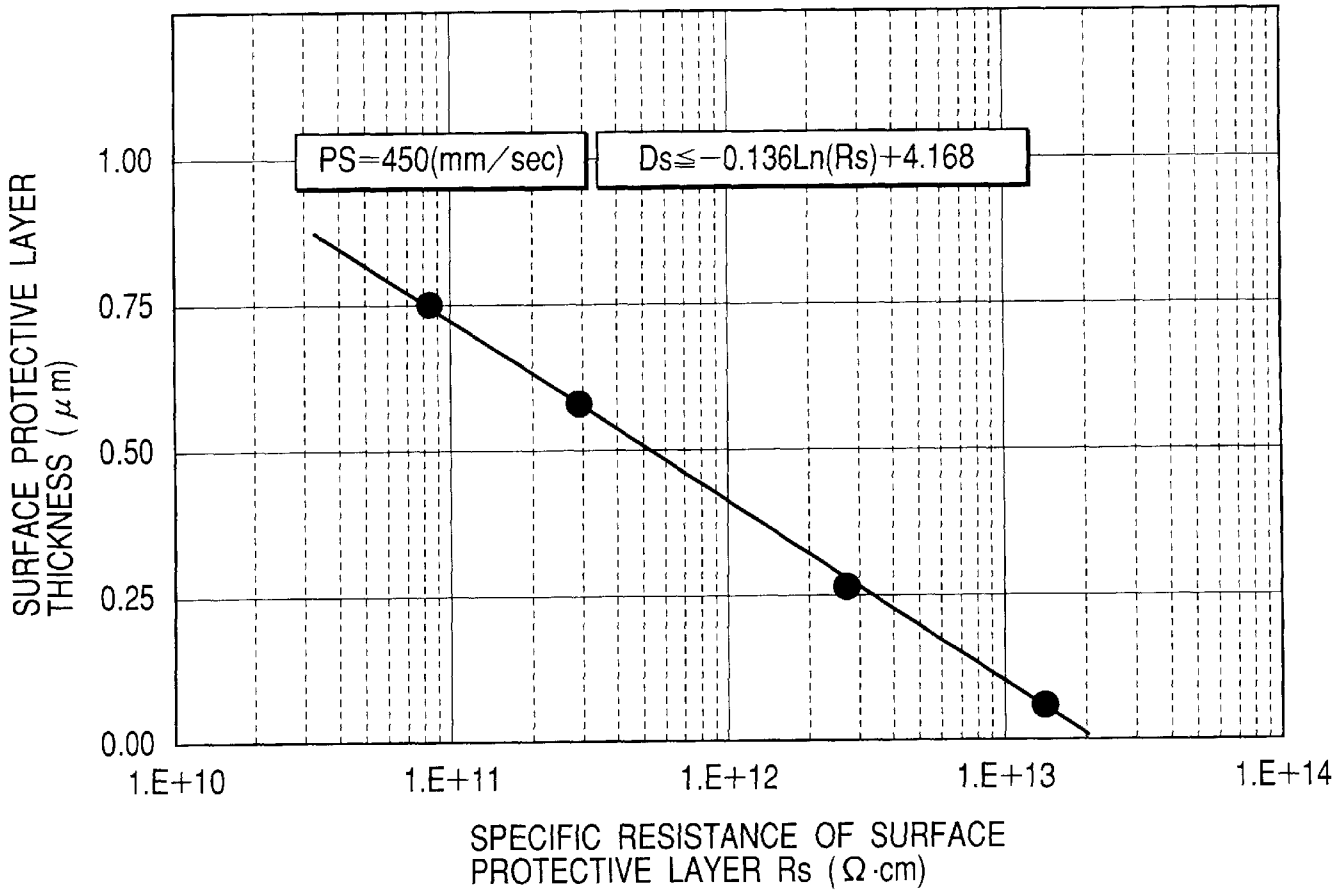
FIG. 9 is a graph showing the relationship between a specific resistance and a thickness of the surface protective layer, obtained by experiment.

From the result of Table 9, it can be seen that in order to make the potential decreasing rate 30% or less, it is necessary to adjust the film thickness (Ds) and specific resistance value (Rs) of the surface protective layer. Furthermore, detailed investigation was performed and the correlation shown in FIG. 9 was obtained from the result of searching for the relationship between Rs and Ds that is required in order to make the potential decreasing rate 30%.

That is, in order to control the potential decreasing rate to be 30% or less, and to prevent the image defect from occurring, it is necessary to regulate the specific resistance value (Rs) and film thickness (Ds) of the surface protective layer so as to fulfill the following relation:

$$Ds \leqq -0.136Ln(Rs)+4.168 \ldots PS=450 \text{ mm/sec} \quad \text{Formula (1)}$$

wherein Ln represents a natural logarithm.

Figure 10:
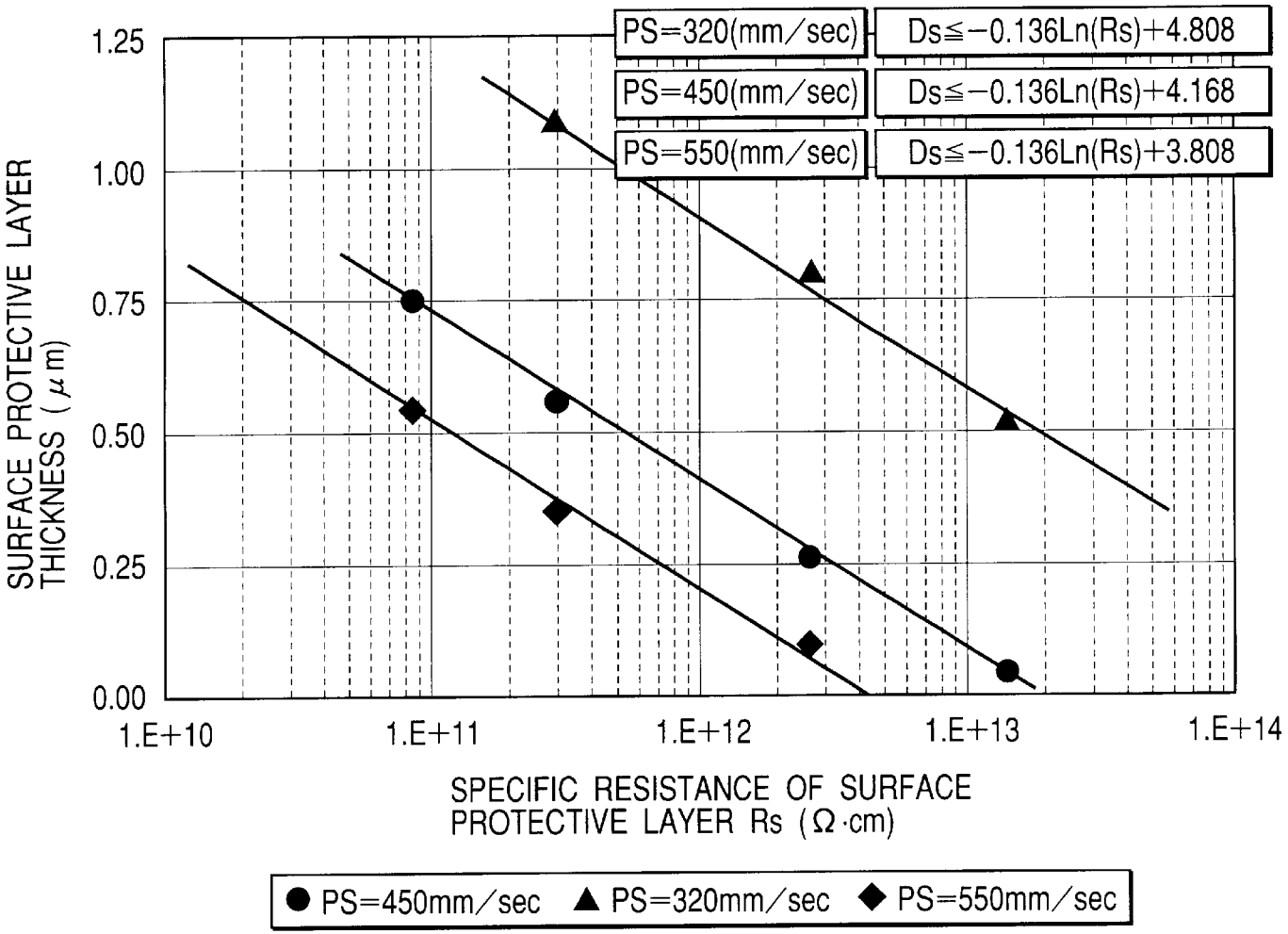
FIG. 10 is a graph showing the relationship between a specific resistance and a thickness of the surface protective layer, obtained by experiment.

Furthermore, the results of the same experiment for the surface moving speed PS of 320 mm/sec and 550 mm/sec are shown in FIG. 10. The following formulas were derived from the correlation shown in FIG. 10 as the relationship between Rs and Ds in each surface moving speed PS.

$$Ds \leqq -0.136Ln(Rs)+4.808 \ldots PS=320 \text{ mm/sec} \quad \text{Formula (2)}$$

$$Ds \leqq -0.136Ln(Rs)+3.808 \ldots PS=550 \text{ mm/sec} \quad \text{Formula (3)}$$

That is, the constant terms on the right-hand sides of formulas (1) to (3) can be expressed approximately by a linear function of the surface moving speed of the photosensitive member, and it was confirmed that such a linear function was represented by the following formula (4):

$$f(PS)=(-0.004 \times PS+6) \quad \text{Formula (4)}$$

Therefore, from formulas (1) to (4), it was found that where the following relation is satisfied, deterioration in the charge retention ability due to the stripping discharge of the surface protective layer can be effectively prevented.

$$Ds \leqq -0.136Ln(Rs)+(-0.004 \times PS+6) \quad \text{Formula (5)}$$

Furthermore, a line image after the extensive test was evaluated. The line image was formed as a one-line latent image in the laser scanning direction in the above-mentioned GP605. Next, the space for ten lines was set, the one-line latent image formation was repeated, and the image formed was developed with toner and transferred to paper, and evaluated. As for the line image evaluation, the line width evaluation (presence or absence of ±10% or more discrepancy with respect to the value set at 50 μm) in the one-line and ten-space image. The results obtained are shown in Table 10. In Table 10, ○ indicates that the line width discrepancy is within ±10%, and x indicates that the line width discrepancy exceeds ±10%.

TABLE 10

| Film Thickness (μm) | Photo-sensitive Member A 1.1E+8 | Photo-sensitive Member B 1.0E+9 | Photo-sensitive Member C 8.5E+10 | Photo-sensitive Member D 2.9E+11 | Photo-sensitive Member E 9.5E+12 | Photo-sensitive Member F 1.4E+13 |
|---|---|---|---|---|---|---|
| 0.1 | X | ○ | ○ | ○ | ○ | X |
| 0.3 | X | ○ | ○ | ○ | X | X |
| 0.4 | X | ○ | ○ | ○ | X | X |
| 0.5 | X | ○ | ○ | ○ | X | X |
| 0.6 | X | ○ | ○ | X | X | X |
| 0.7 | X | ○ | ○ | X | X | X |

TABLE 10-continued

| Film Thickness (μm) | Photo-sensitive Member A 1.1E+8 | Photo-sensitive Member B 1.0E+9 | Photo-sensitive Member C 8.5E+10 | Photo-sensitive Member D 2.9E+11 | Photo-sensitive Member E 9.5E+12 | Photo-sensitive Member F 1.4E+13 |
|---|---|---|---|---|---|---|
| 0.8 | X | ○ | X | X | X | X |
| 1.0 | X | ○ | X | X | X | X |
| 1.2 | X | ○ | X | X | X | X |

*○ and X synthetically indicate the results of the solid white image evaluation and the line width evaluation, hence denote that no problem occurs in both the evaluations and that a problem occurs in either or both of the evaluations, respectively.

As shown in Table 10, although no problem of the charge retention ability due to the stripping discharge occurred in the photosensitive member A with the specific resistance value of the surface protective layer of 1.1E+8(=$1.1\times10^8$) (Ω·cm), charges escaped through the surface of the photosensitive member because the surface protective layer had a low resistance, and as a result, the line width became thin.

Therefore, from the results shown in Tables 9 and 10, it was confirmed that it is necessary that the range of the specific resistance values of the surface protective layer is $1.0\times10^9 \leqq Rs \leqq 1.0\times10^{13}$.

In addition, investigating the surface protective layer made of a-C(H) in the same way as in the above, the same results were obtained.

EMBODIMENTS

Embodiments of the present invention will be described below, but the present invention is by no means limited thereto.

In the same method as shown in Experiment 4, photosensitive member was produced, where the film thickness (Ds) and specific resistance value (Rs) of the surface protective layers were shown in Table 11.

TABLE 11

| | Film Thickness of surface protective Layer (μm) | Specific Resistance Value of Surface Protective Layer (Ω · cm) |
|---|---|---|
| Photosensitive Member G | 0.5 | 2.3E+11 |

Embodiment 1

The photosensitive member shown in Table 11 was mounted on a digital copying machine GP605 (made by Canon Inc.) in which the surface moving speed of a photosensitive member was so modified as to be 300 mm/sec, and an extensive test, where 1,000,000-sheet copies were made on A4-sized paper in the width direction, was performed in the environment A(N/L) shown in Table 2 by using the chart 501 shown in FIG. 5.

After the extensive test, evaluation was made on image defects in the same way as in Experiment 1, and it was found that no image defect occurred. Even after the extensive test, it was also possible to obtain good images.

Embodiment 2

The photosensitive member produced in the same way as in Embodiment 1 was mounted on a digital copying machine GP605 (made by Canon Inc.) in which the surface moving speed of a drum was so modified as to be 450 mm/sec, and an extensive test, where 1,000,000-sheet copies were made on A4-sized paper in the width direction, was performed in the environment A(N/L) shown in Table 2 by using a chart 501 shown in FIG. 5.

After the extensive test, evaluation was made on an image defects in the same way as in Experiment 1, and it was found that no image defect occurred. Even after the extensive test, it was also possible to obtain good images.

Embodiment 3

The photosensitive member produced in the same way as in Embodiment 1 was mounted on a digital copying machine GP605 (made by Canon Inc.) in which the surface moving speed of a drum was so modified to be 500 mm/sec, and an extensive test, where 1,000,000-sheet copies were made on A4-sized paper in the width direction, was performed in the environment A(N/L) shown in Table 2 by using a chart 501 shown in FIG. 5.

After the extensive test, evaluation was made on image defects in the same way as in Experiment 1, and it was found that no image defect occurred. Even after the extensive test, it was also possible to obtain good images.

Embodiment 4

The photosensitive member produced in the same way as in Embodiment 1 was mounted on a digital copying machine GP605 (made by Canon Inc.) in which the surface moving speed of a drum was so modified as to be 550 mm/sec, and an extensive test, where 1,000,000-sheet copies were made on A4-sized paper in the width direction, was performed in the environment A(N/L) shown in Table 2 by using a chart 501 shown in FIG. 5.

After the extensive test, evaluation was made on image defects in the same way as in Experiment 1, and it was found that no image defects occurred. Even after the extensive test, it was also possible to obtain good images.

According to the present invention, in the electrophotographic process which employs a reverse development method using a cleaning blade, the surface moving speed of a photosensitive member and the film thickness and specific resistance value of a surface protective layer of the photosensitive member are specified, so that even in a high-speed electrophotographic process, deterioration in the charge retention ability of the photosensitive member due to the stripping electric discharge can be prevented and clear images with no image defect can be obtained over a long period of time.

What is claimed is:

1. An electrophotographic process comprising the steps of:

pre-exposing a photosensitive member comprising a conductive substrate, and a photoconductive layer formed of an amorphous material containing silicon and a surface protective layer overlaid on the substrate, charging the photosensitive member, forming an electrostatic latent image on the photosensitive member, developing the latent image by reverse development, and cleaning the surface of the photosensitive member with a cleaning blade so provided as to come into contact with the photosensitive member, wherein a surface moving speed of the photosensitive member PS (mm/second) is 320 mm/second or more, and where a film thickness and a specific resistance of the surface protective layer are represented respectively by Ds ($\mu$m) and Rs (ohm.cm), the following conditions are satisfied:

$$1.0\times10^{9}\leqq Rs\leqq 1.0\times10^{13}$$

$$Ds\leqq -0.136Ln(Rs)+(-0.004\times PS+6)$$

in which Ln represents a natural logarithm wherein, when on completion of 1,000,000-sheet copies of a sequence of solid black images having a latent image density of 100%, a dark portion potential of the photosensitive member is measured by a potential measuring method using a voltage direct-application method, the following conditions are satisfied:

$$(Vd0-Vd1)/Vd0\leqq 0.30$$

where Vd0 is a potential at an initial stage and Vd1 is a potential on completion of 1,000,000-sheet copies.

2. An electrophotographic process according to claim 1, wherein the surface protective layer comprises amorphous silicon carbide containing H and/or halogen or amorphous carbon containing H and/or halogen.

* * * * *

UNITED STATES PATENT AND TRADEMARK OFFICE

CERTIFICATE OF CORRECTION

PATENT NO. : 6,686,109 B2
DATED : February 3, 2004
INVENTOR(S) : Hideaki Matsuoka et al.

It is certified that error appears in the above-identified patent and that said Letters Patent is hereby corrected as shown below:

Column 2,
Line 37, “sripping” should read -- stripping --.

Column 3,
Line 6, “logarithm)” should read -- logarithm --.

Column 6,
Line 2, “thicness” should read -- thickness --.
Line 14, “include” should read -- includes --.
Line 17, “photocunductive” should read -- phtoconductive --.
Line 36, “aadition” should read -- addition --.

Column 7,
Line 23, “photocnductive” should read -- the photoconductive --.

Column 9,
Line 24, “bring” should read -- bringing --.

Column 10,
Line 55, “(not shown)” should read -- (not shown) --.

Column 11,
Line 26, “may be” should read -- may also --.
Line 27, “also” should read -- be --.

Column 15,
Line 66, “of of” should read -- of --.

UNITED STATES PATENT AND TRADEMARK OFFICE

CERTIFICATE OF CORRECTION

PATENT NO. : 6,686,109 B2
DATED : February 3, 2004
INVENTOR(S) : Hideaki Matsuoka et al.

It is certified that error appears in the above-identified patent and that said Letters Patent is hereby corrected as shown below:

Column 20,
Line 21, “an image” should read -- image --.

Signed and Sealed this

Thirteenth Day of July, 2004

JON W. DUDAS
*Acting Director of the United States Patent and Trademark Office*